US008864257B2

(12) United States Patent
Veis

(10) Patent No.: US 8,864,257 B2
(45) Date of Patent: Oct. 21, 2014

(54) PRINTING USING A BACKWARDS MOTION

(75) Inventor: Alex Veis, Kadima (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 253 days.

(21) Appl. No.: 13/287,301

(22) Filed: Nov. 2, 2011

(65) Prior Publication Data

US 2013/0106931 A1 May 2, 2013

(51) Int. Cl.

| | |
|---|---|
| ***B41J 29/38*** | (2006.01) |
| ***B41J 2/015*** | (2006.01) |
| ***B41J 19/76*** | (2006.01) |
| ***B41J 11/42*** | (2006.01) |

(52) U.S. Cl.

CPC ..... *B41J 19/76* (2013.01); *B41J 11/425* (2013.01)

USPC ..... 347/9; 347/5; 347/20

(58) Field of Classification Search

USPC ..... 347/5, 9, 20

See application file for complete search history.

(56) References Cited

U.S. PATENT DOCUMENTS

| | | | | |
|---|---|---|---|---|
| 7,152,950 | B2 | 12/2006 | Takekoshi et al. | |
| 7,382,495 | B2 | 6/2008 | Liu et al. | |
| 7,837,319 | B2 | 11/2010 | Rodin et al. | |
| 2003/0151167 | A1 * | 8/2003 | Kritchman et al. | 264/401 |
| 2006/0238595 | A1 * | 10/2006 | Park | 347/104 |
| 2010/0053247 | A1 | 3/2010 | Kakutani | |
| 2011/0148970 | A1 | 6/2011 | Tsuboi et al. | |

FOREIGN PATENT DOCUMENTS

| | | |
|---|---|---|
| JP | 2004216793 | 8/2004 |

* cited by examiner

*Primary Examiner* — Jason Uhlenhake

(57) ABSTRACT

A printer is disclosed. The printer prints a swath of ink across the paper in a first direction. The printer moves the media with respect to the print head in a backwards direction and prints a second swath of ink across the media in a second opposite direction. The printer then moves the media with respect to the print head in a forwards direction by a different amount. The printer then repeats printing the two swaths as describe above.

15 Claims, 3 Drawing Sheets

PRINTING USING A BACKWARDS MOTION

BACKGROUND

Many printers use bidirectional printing where the print head is moved back and forth across the media one or more times as the print head prints swaths of data. The print head is typically moved by some fraction of the head width forwards between each swath. Because each swath is printed in a different direction the UV lamps used to dry the different swaths are not the same. The different UV lamps can cause different amounts of gloss between the different swaths. Having different levels of glossiness in different bands of the image is an image defect and is typically called gloss banding.

DETAILED DESCRIPTION

FIGS. 1-4, and the following description depict specific examples. For the purpose of teaching inventive principles, some conventional aspects have been simplified or omitted. Those skilled in the art will appreciate variations from these examples. The features described below can be combined in various ways to form multiple examples. As a result, the claims are not limited to the specific examples described below.

Figure 1:
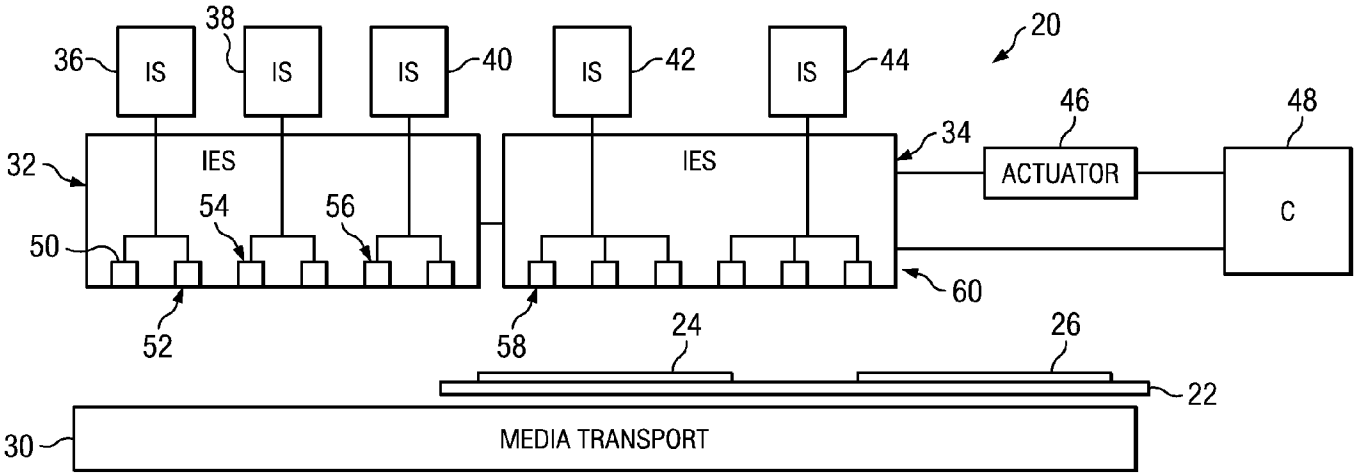
FIG. 1 schematically illustrates a printing system 20 according to an example.

FIG. 1 schematically illustrates a printing system 20 according to an example. Printing system 20 is configured to deposit one or more printing inks or ink upon a print medium 22 to form images such as graphics or photos. Printing system 20 includes media transport 30, ink ejection systems 32, 34, ink supplies 36, 38, 40, 42, 44, actuators 46 and controller 48. Media transport 30 comprises one or more devices configured to move and position print medium 22 with respect to ink ejection systems 32, 34. In an example, media transport 30 may be configured to move individual sheets of media. In another example, media transport 30 may be configured to move a web of media. In an example, media transport 30 include media contacting and engaging mechanisms such as rollers, belts, vacuum table and the like which position media upon a platen opposite the ejection systems. In another example, media transport 30 may comprise a cylinder or drum about which the sheet or web of print media is supported.

Ink ejection system 32, 34 comprise mechanisms configured to selectively eject or deposit printing ink onto print medium 22. In an example, each of ink ejection systems 32, 34 includes a multitude of nozzles 50 through which ink is ejected. In the example illustrated, ink ejection system 32 includes a first set 52 of nozzles 50 (the number and configuration of which are schematically shown) for ejecting ink provided by ink supply 36 and a second set 54 of nozzles 50 for ejecting ink supplied by ink supply 38 and a third set of nozzles 56 for ejecting ink supplied by ink supply 40. Likewise, ink ejection system 34 includes a first set of nozzles 58 for ejecting ink supply by ink supply 42 and a second set of nozzles 60 for ejecting ink supplied by ink supply 44. According to an example, each of ink ejection systems 32, 34 comprise thermoresistance or piezoelectric (or other) inkjet print heads. In another example, each of ink ejection systems 32, 34 may comprise other ink ejecting mechanisms such as resistive inkjet print heads. Although the sets 52-60 of nozzles 50 are illustrated as being apportioned among the two ink ejection systems 32, 34, in other examples, these sets 52-60 of nozzles 50 may alternatively be provided by a single ink ejection system or be apportioned among greater than two ink ejection systems.

Ink supplies 36-44 deliver or supply ink to the nozzles 50 of ink ejection system 32, 34. In an example, ink supply 36-44 may comprise cartridges, tanks or other containers remote from fluid ejection systems 32, 34, wherein a tube or other conduits delivers ink from the ink supply to the fluid ejection system. For example, ink supplies 36-44 may comprise "off-axis" ink supplies. In another example, ink supplies 36-44 may comprise compartments or chambers mounted to or provided as part of ink ejection systems 32, 34. For example, ink ejection systems 32, 34 and their associated ink supplies 36-44 may be provided by one or more integrated cartridges having both nozzles 50 and one or more of the fluid supplies 36-44.

In the example illustrated, ink ejection system 32 and its associated ink supplies 36-40 supply and eject different chromatic inks onto print medium 22. In the example illustrated, ink supplies 36, 38 and 40 supply cyan, magenta and yellow inks, respectively to nozzles sets 52-56 of ink ejection system 32. In other examples, ink ejection system 32 may be provided with additional nozzles sets and may be supplied with different or additional chromatic inks from additional ink supplies. Examples of additional or alternative chromatic inks include light or dark yellow, light or dark cyan or light or dark magenta inks. In the example illustrated, each of the chromatic inks supplied by ink supply 36-40 are pigment-based inks. In other examples, the inks of supplies 36-38 may alternatively be dye-based inks. In examples in which printing system 20 does not print color images, ink ejection system 32 and ink supplies 36-40 may be omitted.

Ink supplies 42, 44 supply different pigment-based inks which are deposited by sets 58, 60 of nozzles 50, respectively, such that the different pigment-based inks may be applied on top of one another or may be applied separately at each image dark portion to form dark or black portions of an image. In other words, rather than dark portions of the image being formed from a single black ink, dark portions of the image may be formed from the two different pigment-based inks separately printed upon a media, one being a black ink and the other being a grayscale ink (including black ink and gray ink).

Actuator 46 comprises one or more mechanisms configured to move or scan ink ejection systems 32, 34 across or relative to media transport 30 as well as print medium 22. The media is moving in steps. The heads are scanning in an orthogonal direction to the media motion while the media is static between steps. In an example, actuator 46 may comprise a motor configured to drive a belt or cable couple to a carriage supporting ink ejection system 32, 34. As ink ejection systems 32, 34 are moved or scanned across a print medium 22, ink is ejected onto print medium 22. Between such scans, media transport 30 may further be indexing or moving media 22 in a direction substantially orthogonal to the direction which actuator 46 is moving ink ejection system 32, 34. Media transport 30 can move media in both a forwards and backwards direction that is substantially orthogonal to the direction which actuator 46 is moving ink ejection system 32, 34. In other examples, media transport may move the media in an axis that is not substantially orthogonal to the direction which actuator 46 is moving ink ejection system 32, 34.

Controller 48 comprises one or more processing units configured to generate control signals controlling and directing movement of print medium 22, movement of ink ejection system 32, 34 by actuator 46 (unless ink ejection systems 32, 34 are part of the page-wide-array) and the ejection of ink onto print medium 22 by nozzles 50. Controller communicates with media transport 30, ink ejection system 32, 34 and actuator 46 in a wired or wireless fashion.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other examples, hard wired circuitry may be used in place of or in combination with software instructions to implement the functions described. For example, controller 48 may be embodied as part of one or more application-specific integrated circuits (ASICs). Unless otherwise specifically noted, the controller is not limited to any specific combination of hardware circuitry and software, nor to any particular source for the instructions executed by the processing unit.

Figure 2:
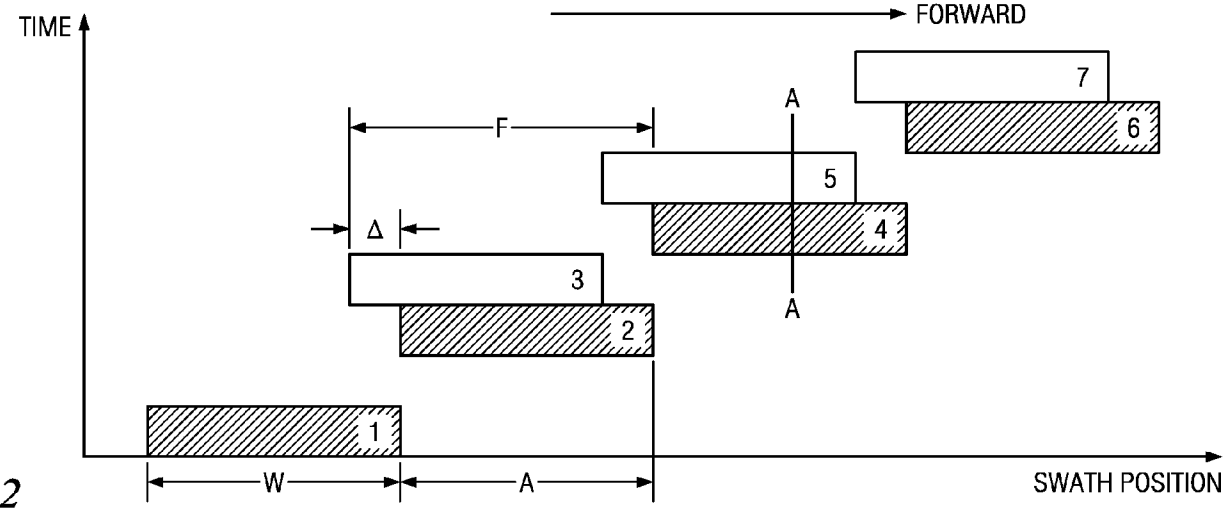
FIG. 2 is a plot of swath printing locations vs. time in an example.

FIG. 2 is a plot of swath printing locations vs. time in an example. Each block represents a swath of ink printed by a print head. The print head is W wide creating swaths that are W wide when a full swath is printed. The shaded blocks represent swaths printed with the print head moving in one direction, for example left-to-right. The un-shaded blocks represent swaths printed in the other direction, for example right-to-left. The position of the blocks represents their location on the media. The numbers inside the blocks represent the order in which the swaths were printed. The print head moves in and out of the plane of the paper when printing swaths of ink. The printing or forwards direction of the print head with respect to the paper or media is shown by the forward arrow. The backwards direction is the opposite direction of the forwards direction. In general the printing direction of the print head with respect to the media is orthogonal with respect to the direction of the print head when printing swaths.

The print head movement in the printing direction for the image shown in FIG. 2 is listed in table 1 below.

TABLE 1

| Swath | Print head movement | |
|---|---|---|
| 1 | zero | Start-up cycle |
| 2 | A forwards (W) | Start-up cycle |
| 3 | Δ Backwards | Normal cycle (step A) |
| 4 | F Forwards (W + Δ) | Normal cycle (step B) |
| 5 | Δ Backwards | Normal cycle (step A) |

In Table 1, the first column lists the swaths in the order they are printed. Column 2 shows the relative print head movement between each swath. Column 3 lists the swath type, for example a start-up swath.

The image shown in FIG. 2 is created with two layers of ink (i.e. one swath deposited on top of another swath). In an example, there are two startup swaths printed first, swath 1 and swath 2. Swath one is the first swath printed. The print head is then moved in the forwards direction one full width W and then swath 2 is printed. Swath 1 and 2 are both printed in the left-to-right direction. When the head moves back in the right-to-left direction after printing swath 1, a swath is not printed.

Swath 3 starts the normal printing cycle (step A). The print head is moved backwards by distance Δ before swath 3 is printed. By moving backwards, swath 3 is printed on top of swaths 1 and 2. Swath 3 is printed in the right-to-left direction (i.e. the opposite direction from swaths 1 and 2). Distance Δ is less than the full width W. Distance Δ can be any fraction of the print head width. After printing swath 3 the print head is moved in the forwards direction by distance F. Distance F is equal to the sum of distance Δ and the swath width W. Swath 4 is then printed in the left-to-right direction. Swath 4 is the second step (step B) in the normal print cycle. Step A of the normal print cycle is then repeated by moving the print head backwards by distance Δ before swath 5 is printed. Step B of the normal print cycle is completed by moving the print head forwards by distance F and printing the next swath.

The two step normal print cycle is repeated until the image has been printed. Any vertical line drawn on FIG. 2 will cut the number of swaths used for the printed image. For example, line AA cuts swaths 4 and 5 showing that this image is created with two swaths. The print head advances by 1 full print head or swath width (distance Δ) with the completion of each two step cycle (Δ backwards for step A, Δ+W forwards for step B). By moving the print head backwards as every other swath is printed, all the swaths that are printed on the top layer of the image are printed in the same direction (i.e right-to-left in this example). In addition the ink printed in the top level covers all the ink printed in the lower levels. By printing all the top layers of ink in the same direction the difference in gloss for each swath (if any) is minimized.

In FIG. 2, swath 1 is shown as using the full width of the print head (for clarity). This creates an edge effect at the start of the image where only one layer of ink is printed on the media. However in actual use, the full width of the print head may not be used when printing swath 1 such that the edge effect at the beginning of the image is eliminated. A partial width of the print head may also be used at the end of the image.

Many images are created using more than two swaths of ink or passes of the print head over each location on the media. In general each swath of a multi swath image is printed using 1/(number of swaths) of the total amount of ink for each separation or ink color. For example, when printing an image using 4 different swaths, each swath for a given color will print ¼ of the ink for that color. Of course most printers are printing 3 or 4 colors at the same time, so each swath printed for a 4 swath image will contain ¼ the total ink for each color printed.

Figure 3:
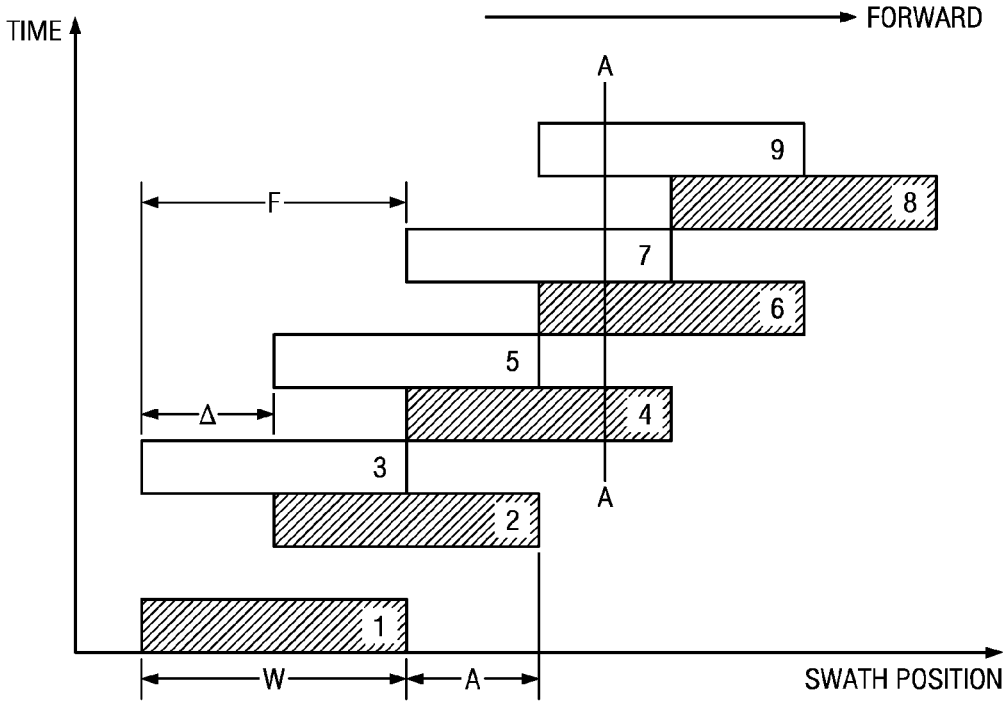
FIG. 3 a plot of swath printing locations vs. time for an image printed using 4 swaths in an example.

FIG. 3 is a plot of swath printing locations vs. time for an image printed using 4 swaths in an example. Each block represents a swath of ink printed by a print head. The print head is W wide creating swaths that are W wide when a full swath is printed. The shaded blocks represent swaths printed with the print head moving in one direction, for example left-to right. The un-shaded blocks represent swaths printed in the other direction, for example right-to-left. The position of the blocks represents their location on the media. The numbers inside the blocks represent the order in which the swaths were printed. The print head moves in and out of the plane of the paper when printing swaths of ink. The printing or forwards direction of the print head with respect to the paper or media is shown by the forward arrow. The backwards direction is in the opposite direction of the forward direction.

In general the printing or forward direction of the print head is orthogonal with respect to the direction of the print head when printing swaths.

The print head movement in the printing direction for the image shown in FIG. 3 is listed in table 2 below.

TABLE 2

| Swath | Print head movement | |
|---|---|---|
| 1 | zero | Start-up cycle |
| 2 | A forwards (½ W) | Start-up cycle |
| 3 | Δ Backwards (½ W) | Normal cycle (step A) |
| 4 | F Forwards (W) | Normal cycle (step B) |
| 5 | Δ Backwards (½ W) | Normal cycle (step A) |
| 6 | F Forwards (W) | Normal cycle (step B) |
| 7 | Δ Backwards (½ W) | Normal cycle (step A) |
| 8 | F Forwards (W) | Normal cycle (step B) |
| 9 | Δ Backwards (½ W) | Normal cycle (step A) |

In Table 2, the first column lists the swaths in the order they are printed. Column 2 shows the relative print head movement between each swath. Column 3 lists the swath type, for example a start-up swath.

The image shown in FIG. 3 is created with four layers of ink. In an example, there are two startup swaths printed first, swath 1 and swath 2. Swath one is the first swath printed. The print head is then moved in the forwards direction by distance Δ and then swath 2 is printed. Swath 1 and 2 are printed in the left-to-right direction. When the head moves back in the right-to-left direction after printing swath 1, a swath is not printed. Distance A is ½ the swath width W.

Swath 3 starts the normal printing cycle (step A). The print head is moved backwards by distance Δ before swath 3 is printed. By moving backwards, swath 3 is printed on top of swaths 1 and 2. Swath 3 is printed in the right-to-left direction. Distance Δ is less than the full width W. In FIG. 3 distance Δ is shown as ½ the swath width, but distance Δ could be any fraction of the swath width. After printing swath 3 the print head is moved in the forwards direction by distance F. Distance F is equal to the swath width W. Swath 4 is then printed in the left-to-right direction. Swath 4 is the second step (step B) in the normal print cycle. Step A of the normal print cycle is then repeated by moving the print head backwards by distance Δ before swath 5 is printed. Step B of the normal print cycle is completed by moving the print head forwards by distance F and printing the swath 6.

The two step normal print cycle is repeated until the image has been printed. Any vertical line drawn on FIG. 3 will cut the number of swaths used for the printed image. For example, line AA cuts swaths 4, 6, 7 and 9 showing that this image is created with four swaths. The print head advances by ½ the full print head or swath width (distance Δ) with the completion of each two step cycle (Δ backwards (½ W) for step A, F forwards (W) for step B). By moving the print head backwards as every other swath is printed, all the swaths that are printed on the top layer of the image are printed in the same direction (i.e right-to-left in this example). In addition the ink printed in the top level covers all the ink printed in the lower levels. By printing all the top layers of ink in the same direction the difference in gloss for each swath (if any) is minimized.

In FIG. 3, swath 1 and 3 are shown as using the full width of the print head (for clarity). This creates and edge effect at the start of the image where less than 4 layers of ink is printed on the media. However in actual use, the full width of the print head may not be used when printing swath 1 and 3 such that the edge effect at the beginning of the image is eliminated. A partial width of the print head may also be used at the end of the image.

Figure 4:
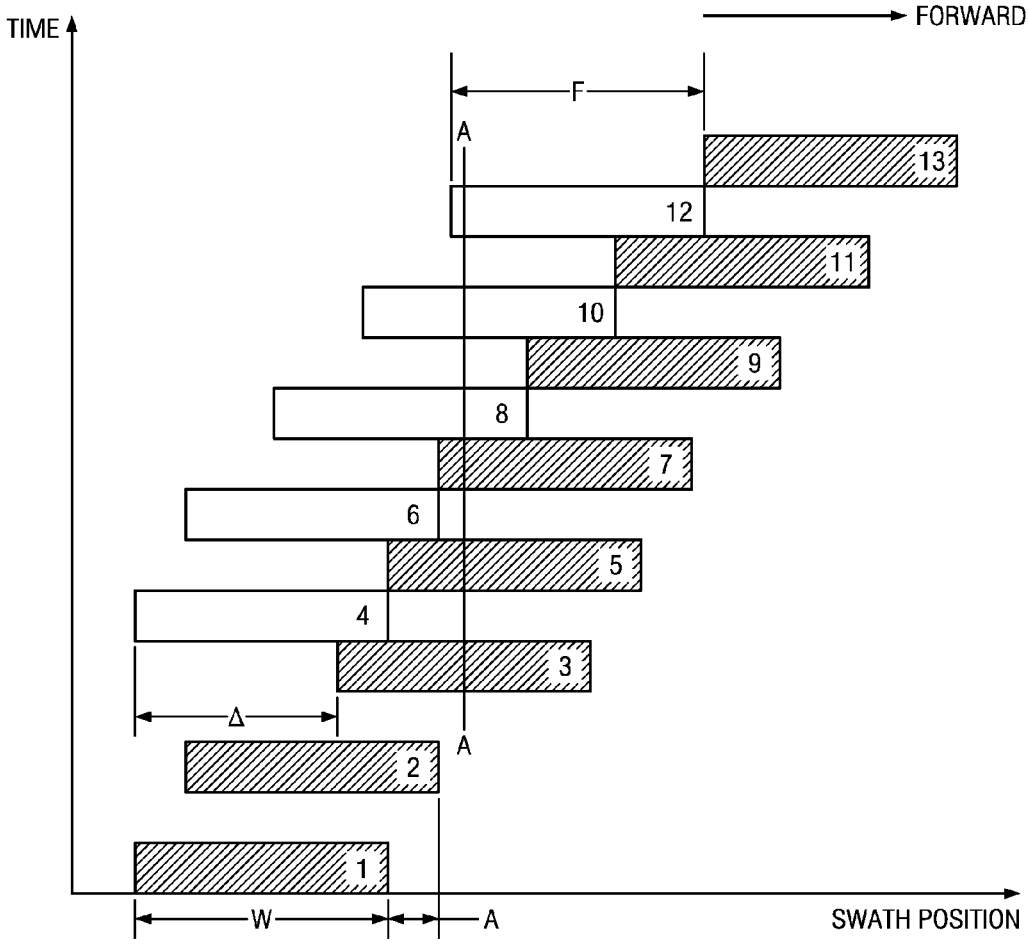
FIG. 4 a plot of swath printing locations vs. time for an image printed using 6 swaths in an example.

FIG. 4 a plot of swath printing locations vs. time for an image printed using 6 swaths in an example. Each block represents a swath of ink printed by a print head. The print head is W wide creating swaths that are W wide when a full swath is printed. The shaded blocks represent swaths printed with the print head moving in one direction, for example left-to-right. The un-shaded blocks represent swaths printed in the other direction, for example right-to-left. The position of the blocks represents their location on the media. The numbers inside the blocks represent the order in which the swaths were printed. The print head moves in and out of the plane of the paper when printing swaths of ink. The printing or forwards direction of the print head with respect to the paper or media is shown by the forward arrow. The backwards direction is in the opposite direction of the forwards direction. In general the printing or forward direction of the print head is orthogonal with respect to the direction of the print head when printing swaths.

The print head movement in the printing direction for the image shown in FIG. 4 is listed in table 3 below.

TABLE 3

| Swath | Print head movement | |
|---|---|---|
| 1 | zero | Start-up cycle |
| 2 | A forwards (⅓ W) | Start-up cycle |
| 3 | A forwards (⅓ W) | Start-up cycle |
| 4 | Δ Backwards (⅔ W) | Normal cycle (step A) |
| 5 | F Forwards (W) | Normal cycle (step B) |
| 6 | Δ Backwards (⅔ W) | Normal cycle (step A) |
| 7 | F Forwards (W) | Normal cycle (step B) |
| 8 | Δ Backwards (⅔ W) | Normal cycle (step A) |
| 9 | F Forwards (W) | Normal cycle (step B) |
| 10 | Δ Backwards (⅔ W) | Normal cycle (step A) |
| 11 | F Forwards (W) | Normal cycle (step B) |
| 12 | Δ Backwards (⅔ W) | Normal cycle (step A) |

In Table 3, the first column lists the swaths in the order they are printed. Column 2 shows the relative print head movement between each swath. Column 3 lists the swath type, for example a start-up swath.

The image shown in FIG. 4 is created with six layers of ink. In an example, there are three startup swaths printed first, swath 1, 2 and 3. Swath one is the first swath printed. The print head is then moved in the forwards direction by distance A and then swath 2 is printed. The print head is then moved in the forwards direction by distance A and then swath 3 is printed. Swath 1, 2 and 3 may be printed in the same left-to-right direction. When the head moves back in the right-to-left direction after printing swath 1 and 2, a swath is not printed. Distance A is ⅓ the swath width W.

Swath 4 starts the normal printing cycle (step A). The print head is moved backwards by distance Δ before swath 4 is printed. By moving backwards, swath 4 is printed on top of swaths 1, 2 and 3. Swath 4 is printed in the right-to-left direction. Distance Δ is less than the full width W. In FIG. 4 distance Δ is shown as ⅔ the swath width, but distance Δ could be any fraction of the swath width. After printing swath 4 the print head is moved in the forwards direction by distance F. Distance F is equal to the swath width W. Swath 5 is then printed in the left-to-right direction. Swath 5 is the second step (step B) in the normal print cycle. Step A of the normal print cycle is then repeated by moving the print head backwards by distance Δ before swath 6 is printed. Step B of the normal print cycle is completed by moving the print head forwards by distance F and printing the swath 7. When swath 8 is printed the image is the full 6 layers thick.

The two step normal print cycle is repeated until the image has been completely printed. Any vertical line drawn on FIG. 4 will cut the number of swaths used for the printed image. For example, line AA cuts swaths 3, 5, 7, 8, 10 and 12 showing that this image is created with six swaths. The print head advances by ⅓ the full print head or swath width (distance A) with the completion of each two step cycle (A backwards (⅔ W) for step A, F forwards (⅓ W) for step B). By moving the print head backwards as every other swath is printed, all the swaths that are printed on the top layer of the image are printed in the same direction (i.e., right-to-left in this example). In addition the ink printed in the top level covers all the ink printed in the lower levels. By printing all the top layers of ink in the same direction the difference in gloss for each swath (if any) is minimized.

In FIG. 4, swath 1, 2, 4 and 6 are shown as using the full width of the print head (for clarity). This creates and edge effect at the start of the image where less than 6 layers of ink is printed on the media. However in actual use, the full width of the print head may not be used when printing swath 1, 2, 4 and 6 such that the edge effect at the beginning of the image is eliminated. A partial width of the print head may also be used at the end of the image.

Images with 2, 4, or 6 layers were discussed in the examples above. In other examples, images with different numbers of layers can be formed.

What is claimed is:

1. A printer, comprising:

a print head to print ink onto media;

a print head transport system to move the print head along a first axis;

a media transport system to move the media along a second axis; and a controller to control the print head transport system and the media transport system, the controller to:

a) print a swath with the print head in a first direction along the first axis;

b) move the media in a backwards direction along the second axis by a first distance;

c) print a swath with the print head in a second direction opposite the first direction along the first axis;

d) move the media in a forward direction along the second axis by a second distance, the first distance being different than the second distance; and e) repeat a)-d) at least once.

2. The printer of claim 1, wherein each swath is printed using a full width of the print head.

3. The printer of claim 1, wherein an advance distance is the distance in the forward direction in d) minus the distance in the backwards direction in b), and the advance distance is less than two full swath widths.

4. The printer of claim 1, wherein the first distance comprises at least one of: 1/16 a full swath width, ⅛ a full swath width, ¼ a full swath width, ⅓ a full swath width, and ½ a full swath width.

5. The printer of claim 1, wherein the first axis is perpendicular to the second axis.

6. The printer of claim 1, wherein the controller is to print at least one startup swath before the swath is printed the first time a) is performed.

7. The printer of claim 1, wherein the controller prints at least one startup swath before the swath is printed the first time a) is performed.

8. A method of printing, comprising:

a) printing a swath in a first direction across media;

b) moving the media in a backwards direction by a first distance;

c) printing a swath in a second direction across the media, the second direction being opposite the first direction;

d) moving the media in a forward direction by a second distance different than the first distance; and e) repeating a)-d) at least once.

9. The method of printing of claim 8, wherein the first direction is perpendicular to the backwards direction.

10. The method of printing of claim 8, wherein each swath is printed using a full width of a print head.

11. The method of printing of claim 8, wherein an advance distance is the distance in the forward direction in d) minus the distance in the backwards direction in b), and the advance distance is less than two full swath widths.

12. The method of printing of claim 8, wherein the second distance is selected from a group of distances comprising: 1/16 a full swath width, ⅛ a full swath width, ¼ a full swath width, ⅓ a full swath width, and ¼ a full swath width.

13. The method of printing of claim 8, wherein the first direction is perpendicular to the forward direction.

14. The method of printing of claim 8, wherein an image formed using the method of claim 7 comprises at least one of: 2 layers, 4 layers, 6 layers, 8 layers, 10 layers, 12 layers, and 16 layers.

15. A method of printing, comprising:

printing an image using at least two layers of ink printed using a plurality of swaths, at least one swath of the plurality of swaths being printed by scanning a print head in a first direction opposite a second direction in which at least one other swath of the plurality of swaths is printed, and wherein each of the plurality of swaths of a top layer of ink in the image is printed in a same direction and the top layer of ink covers the ink in all lower layers of ink.

* * * * *

UNITED STATES PATENT AND TRADEMARK OFFICE

CERTIFICATE OF CORRECTION

PATENT NO. : 8,864,257 B2
APPLICATION NO. : 13/287301
DATED : October 21, 2014
INVENTOR(S) : Alex Veis It is certified that error appears in the above-identified patent and that said Letters Patent is hereby corrected as shown below:

In the Claims

In column 8, line 39, in Claim 14, delete "claim 7" and insert -- claim 8 --, therefor.

Signed and Sealed this
Seventeenth Day of May, 2016

Michelle K. Lee

Michelle K. Lee
*Director of the United States Patent and Trademark Office*